United States Patent [19]

Petrovich

[11] Patent Number: 4,730,430

[45] Date of Patent: Mar. 15, 1988

[54] ABRASIVE TOOL

[76] Inventor: Richard L. Petrovich, 6413 Fordwick Rd., Parma Hts., Ohio 44130

[21] Appl. No.: 94,100

[22] Filed: Sep. 4, 1987

Related U.S. Application Data

[63] Continuation of Ser. No. 845,549, Mar. 28, 1986, abandoned.

[51] Int. Cl.[4] ..... B24D 15/02

[52] U.S. Cl. ..... 51/387; 51/391

[58] Field of Search ..... 51/358, 367, 380, 381, 51/383, 387, 391, 135 R, 141, 148

[56] References Cited

U.S. PATENT DOCUMENTS

| | | | |
|---|---|---|---|
| 713,199 | 11/1902 | Brainard . | |
| 1,274,928 | 8/1918 | Muller . | |
| 2,457,466 | 12/1948 | Hanna . | |
| 2,493,852 | 1/1950 | Bonkowski . | |
| 2,531,588 | 12/1950 | Stucker . | |
| 3,063,208 | 12/1962 | Bell et al. . | |
| 3,106,806 | 10/1963 | Hutchins | 51/358 |
| 3,170,272 | 2/1965 | Burnham | 51/141 |
| 3,465,479 | 9/1969 | Foody et al. | 51/148 |
| 3,510,991 | 5/1970 | Bowen . | |
| 4,525,959 | 7/1985 | Ziebarth | 51/391 |

*Primary Examiner*—Frederick R. Schmidt
*Assistant Examiner*—Maurina Rachuba
*Attorney, Agent, or Firm*—D. Peter Hochberg; Mark M. Kusner; Walter C. Danison, Jr.

[57] ABSTRACT

A relatively thin, hand-held tool for abrading, sanding or polishing a workpiece comprised of an elongated body constructed to carry a flexible, endless strip longitudinally therebout. The body includes handlike portion and a workpiece engaging portion, which define the path. Means associated with the handle portion are provided to align said strip with respect to the workpiece engaging portion. The body further includes means for releasably holding the strip under tension in contact with the path.

20 Claims, 4 Drawing Figures

ABRASIVE TOOL

This is a continuation of co-pending application Ser. No. 845,549 filed on Mar. 28, 1986, now abandoned.

FIELD OF THE INVENTION

The present invention relates to the art of abrasive tools, and more particularly to an elongated, relatively thin device having a removable abrasive strip mounted longitudinally thereabout.

BACKGROUND OF THE INVENTION

In many situations in industry, as well as in the home, an abrasive tool is needed to finish the surface of a workpiece or product. Hand-held sanding blocks or grinders generally find advantageous application when the work surface is large or planar, and sufficient room is available to manipulate such tools. With smaller or more detailed work, or in situations where space adjacent the work surface is limited, such tools are unsuitable. For smaller, more intricate work, it is conventionally known to use a nail file, a small swiss file or a folded piece of abrasive. In many instances, these objects do not provide satisfactory results. Abrading a surface with a nail file or a piece of folded abrasive, not only imposes great strain on the hand, but also generally does not permit smooth application of the abrading element. While a swiss file is easier to manipulate, they are relatively expensive, and are not suitable for some buffing or polishing applications.

The present invention overcomes these and other problems and provides an elongated, relatively thin, hand-held abrasive tool having a removable, endless abrasive strip mounted longitudianlly thereabout. The tool includes a grip portion and a workpiece engaging portion at one end thereof. In this respect, the present invention in many ways is like a file in that the grip portion enables accurate and controlled manipulation of the workpiece engaging portion, and its relatively thin, sleek profile permits its application on detailed, intricate surfaces. Importantly however, the removable abrasive strip permits alternate strips having different abrasive characteristics to be used to achieve specific desired workpiece surface features.

SUMMARY OF THE INVENTION

In accordance with the preferred embodiment of the present invention there is provided a hand-held abrasive tool comprised of a elongated, generally rectangular, body constructed to carry a flexible, endless abrasive strip thereabout on a generally endless path. The body includes a handle portion which comprises a major part of the body. The handle portion includes lateral side walls disposed therealong which side walls align the abrasive strip with respect to a work piece engaging portion at one end of the body. The body is comprised of a first relatively long main body section including the work piece engaging portion and a second shorter body section wherein the sections are in longitudinal coplanar alignment and having adjacent ends. The ends of the sections are connected in a manner which permits limited longitudinal movement therebetween. Means are provided between the sections to bias the sections longitudinally apart. The flexible abrasive strip is disposed on the path between the lateral side walls and retained thereon by the longitudinally biased body sections.

Referring more specifically to the present invention in its preferred form, the body sections are comprised of impact and chemically resistant plastic. The second section includes a longitudinally extending arm which is received in sliding fashion in a longitudinally extending opening in the first section. A lateral extending tab on the arm connects the sections and limits longitudinal movement therebetween. A spring concentric about the arms biases the sections longitudinally apart. The side walls which define the handle portion project above the surface of the path a distance slightly greater than the thickness of the abrasive strip. In this respect, the walls not only align the strip with respect to the work piece engaging portion, they likewise restrict engagement of the abrasive strip disposed on the handle portion from abrasive contact with the workpiece.

The workpiece engaging portion is generally wedge-shaped having one surface coplanar with the surface of the path along the handle portion, and the other surface generally oblique to the axis of the body. As set forth above, the abrasive strip is disposed along the path wherein the resiliency of the biasing spring maintains the interior surface of the strip in contact with the surfce of the path. The spring means are operative to releasably hold the strip under tension in non-slipping relationship to the path. The strip is movable however along the path to permit positioning unused abrasive surface to the workpiece engaging portion of the tool. Accordingly, the present invention provides an abrasive tool having features similar to a swiss file together with additional benefits, such as having an abrasive surface which can be replaced to accommodate a specific application.

An object of the present invention is to provide a hand-held abrasive tool for sanding, buffing, or polishing flat, contoured or intricate surfaces.

Another object of the present invention is to provide an elongated, relatively thin abrasive tool having a remoable abrasive strip mounted longitudinally thereabout.

Another object of the present invention is to provide an abrasive tool as described above, wherein said tool includes a handle portion and a workpiece engaging portion and wherein said abrasive strip can be repeatedly indexed to said workpiece engaging portion to ensure utilization of the entire abrasive surface of said strip.

A still further object of the present invention is to provide an abrasive tool as described above wherein siad abrasive strip can be indexed or replaced quickly without removing or loosening any part of said tool.

A still further object of the present invention is to provide a tool as described above which is lightweight, inexpensive and easy to use.

These and other objects and advantages of the invention wil become apparent from the following description of an embodiment thereof taken together with the accompanying drawings.

BRIEF DESCRIPTION OF THE DRAWINGS

The invention may take physical form in certain parts and arrangement of parts, a preferred embodiment of which will be described in detail in this specification and illustrated in the accompanying drawings wherein .

DETAILED DESCRIPTION OF A PREFERRED EMBODIMENT

Figures 1, 2, 3, 4:
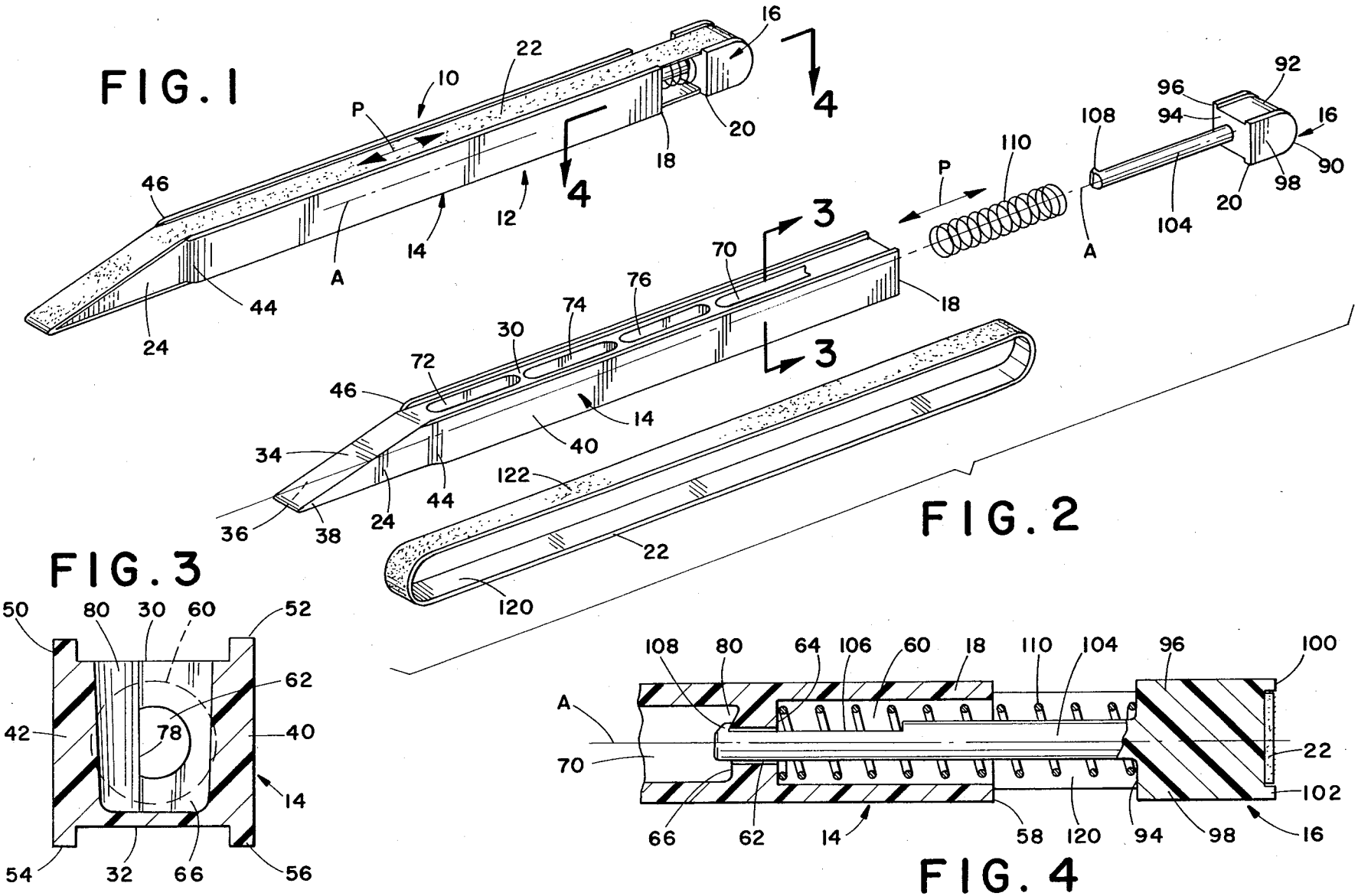
FIG. 1 is a perspective view of an abrasive tool illustrating a preferred embodiment of the present invention.
FIG. 2 is an exploded view of the tool shown in FIG. 1.
FIG. 3 is an enlarged cross-sectional view taken along lines 3—3 of FIG. 2.
FIG. 4 is an enlarged cross-sectional view taken along lines 4—4 of FIG. 1 showing adjacent ends of the body sections and the connection therebetween.

Referring now to the drawings wherein the showings are for the purpose of illustrating a preferred embodiment and not for the purpose of limiting same, FIG. 1 shows a hand-held tool 10 constructed in accordance with the present invention for abrading, sanding, or buffing a workpiece (not shown). Generally, tool 10 includes an elongated, generally rectangular, body generally designated 12 extending along an axis A. Body 12 is comprised of a relatively long main body section 14 and a shorter body section 16 having adjacent ends 18, 20 respectively. Section 14 and 16 are interconnected in a non-detachable manner to effect limited, longitudinal movement therebetween, and further include means biasing them apart. An endless abrasive strip 22 is carried longitudinally about sections 14, 16 along a generally endless path P. The term "abrasive" has and will be used throughout the application to describe strip 22. It will be understood, that the term refers to an abrading, smoothing or polishgin surface. Hereinafter, for the purpose of clarity, the relative position of surfaces and parts of tool 10 will be described with reference to the orientation shown in FIGS. 1 and 2, although it will be appreciated that the tool may be manipulated to any desired position relative to a workpiece.

Main body section 14 is generally prismatic, being generally rectangular in cross-section, and includes a workpiece engaging portion 24 at one end thereof. Relatively long, narrow section surfaces 30, 32 are provided respectively on the upper and lower extent of section 14. Workpiece engaging portion 24 is generally wedge shaped and includes upper and lower work surfaces 34, 36 respectively. In the embodiment shown, lower surfaces 36 of wedge-shaped portion 24 is generally coplanar with section surface 32 and communicates therewith, while upper surface 34 is generally oblique with respect to axis A of tool 10. In this respect, work surfaces 34, 36 intersect to form a radiused point 38.

Wall members 40, 42, best seen in FIG. 3, are provided on opposite sides of section 14 and extend from workpiece engaging portion 24 to end 18. Ends 44, 46 of wall members 40, 42 are radiused or smoothly contoured near workpiece engaging portion 24 to enable tool 10 to be used near obstructions without interference therefrom. As best seen in FIG. 3, wall members 40, 42 include portions which extend beyond section surfaces 30, 32 thereby defining rails or guides 50, 52, 54, 56 which are laterally disposed with respect to surfaces 30, 32.

Referring now to FIGS. 4, end 18 of body section 14 includes a generally flat surface 58 which is generally perpendicular to axis A of tool 10. Openings 60, 62 in surface 58 communicate with a surface 66 in a chamber or cavity 70 formed in section 14. Chamber 70 is one of several such cavities 72, 74, 76 disposed within body section 14. With the exception of chamber 70, the other cavities are provided primarily to reduce the weight of, and the amount of material used in, tool 10, and in and of themselves form no part of the present invention. Where openings 60, 62 intersect, a laterally facing generally annular surface 64 is defined. Opening 60 is larger than opening 62 and is axially aligned therewith. Opening 60 is generally cylindrical in shape, while opening 62 is partially cylindrical and include a flat portion 78, as best seen in FIG. 3. A groove or depression 80 is disposed in surface 66 adjacent opening 62.

Referring now to the body section 16, as can be seen in the drawings, this section is relatively short as compared to body section 14. Section 16 is rectangular in cross-section and has a generally rounded or curved end 90 defining a curved or arcuate surface 92. A flat surface 94 is provided at adjacent end 20. Wall members 96, 98 are provided on opposite sides of section 16, which wall members extend outwardly beyond surface 92 and define guides or railse 100, 102 disposed laterally thereto, as seen in FIG. 4. Respective parts and surfaces of section 16 are dimensioned to be in longitudinal coplanar alignment with section 14.

An elongated stem or arm 104 extends perpendicularly from surface 94 of section 16. Stem 104 is generally cylindrical in shape, but includes a flat portion 106 along a portion thereof. Portion 106 is dimensioned to be slidably received in opening 62 of body section 14. In this respect, flat portion 106 of stem 104 and flat portion 78 of opening 62 are oriented within body sections 16, 14 respectively to effect alignment therebetween. The free end of stem 104 includes a tab 108 laterally extending to one side thereof. Tab 108 is generally inclined or angled back toward section 16 to provide a hook-like or barb-like configuration.

As best seen in FIG. 4, section 14 and 16 are assembled wherein stem 104 is slidably received in opening 62. A spring 110 surrounding stem 104 is received in opening 60 with its ends engaging surfaces 64 and 94 to urge sections 14, 16 longitudinally apart. Separation of sections 14, 16 is limited by tab 108 engaging surface 66 in cavity 70.

Referring now to the assembly of body 12, though other materials can be used, body sections 14, 16 are preferably molded or otherwise formed of an impact and chemical resistant plastic. In this respect, plastic not only provides economy in manufacturing and light weight, it also allows for a snap-lock interconnection between sections 14, 16, thus providing an integral body assembly. More specifically, certain plastic material because of their yielding characteristics, permit stem 104 to be inserted through opening 62 in body section 14. To this end, the inclination of tab 108 facilitates such operation. Once inserted, tab 108 "snaps" laterally outward such that engagement between tab 108 and surface 66 prevents removal of stem 106 from opening 62. It has been found that insertion of stem 104 in hole 62 is easily accomplished if performed relatively soon after molding while the respective parts are still warm. When body sections 14 and 16 are assembled surfaces 30, 32, 34, 36 and 92 define path P upon which strip 22 is positioned.

Strip 22 is an endless loop having an inner surface 120 and an outer surface 122. Strip 22 may have an abrading, buffing, sanding or polishing outer surface 122, depending on the desired surface finish on the workpiece. Strip 22 is dimensioned relative to body 12 to be maintained under tension by spring 110 wherein inner surface 120 is in contact with path P. In this respect, spring 110 is operative to releasably hold strip 22 in non-slipping relationship to path P, wherein strip 22 is movable along path P to locate an unused portion of outer surface 122 on workpiece engaging portion 24. As seen in the drawings, the width of strip 22 is approximately equal to the width of workpiece engaging portion 24.

As set forth above, rail or guides 50–56, 100 and 102 are laterally located on opposite sides of path P and project a predetermined distance outward therefrom. Primarily these guides align strip 22 along path P to ensure proper positioning thereof with respect to wedge-shaped workpiece engaging portion 24 and to prevent strip 22 from slipping or being forced off relatively narrow body 12. In another respect, the guides define a handle portion on tool 10. In general, guides 50–56, 100 and 102 extend above strip 22 such that engagement of outer surface 122 is not possible along this portion of the tool, thereby defining the handle portion.

Accordingly, there is provided a hand held tool for abrading, polish, or sanding a workpiece, which tool, because of its workpiece engaging 24 and handle portion, can be manipulated, controlled and used much like a precision swiss file. Moreover, the tool according to the present invention permits modification of the abading surface by replacement of strip 22. It is likewise inexpensive and easy to fabricate.

As will be appreciated, certain advantages and aspects of the present invention are due to its sleek, thin body which enable it to be grasped and used in a manner similar to a file. Accordingly, a tool according to the present invention will preferably be dimensioned to be easily held by hand and at the same time have a workpiece engaging portion which can be easily manipulated against intricate or small work surfaces. For example, the embodiment heretofore disclosed is approximately 6.5 inches long and 0.375 inches in height and width, wherein strip 22 is approximately 0.250 inches wide. It will be appreciated that these dimensions are for the purpose of illustration only, and are not intended to limit the scope of the disclosed invention.

In this respect, although a preferred embodiment has been described, many modifications may occur to others skilled in the art upon their reading and understanding the specification. For example, workpiece engaging portion 22 may assume other wedge-shaped configurations than that shown or may have a more rounded or even square end. It is intended that all such modifications and alterations be included insofar as they come within the scope of the invention as claimed or the equivalent thereat.

Having thus described the invention, it is claimed:

1. A slender, hand-held abrasive tool for abrading planar or contoured surfaces comprising an elongated, generally prismatic, unitary body assembly constructed to carry a removable, flexible endless abrasive strip longitudinally about said body assembly along a generally endless path, said body assembly including:

a first, relatively long, prismatic main body section, said first body section including a wedge-shaped workpiece engaging portion;

a second, relatively short body section;

said first and second body sections being of molded plastic construction with each section having laterally disposed, longitudinally extending side walls for aligning said strip with respect to said workpiece engaging portion, and an end adjacent a corresponding end of the other body section, said body sections being in longitudinal alignment and a side wall of each body section being aligned with a corresponding side wall of the other body section to form a handle portion;

biasing means for biasing said body sections longitudinally apart; and, connecting means permanently joining said body sections and said biasing means to form said unitary body assembly, said connecting means allowing limited longitudinal movement between said body sections, wherein said biasing means is operative to releasably hold said strip under tension in non-slipping relationship to said path.

2. An abrasive tool as defined in claim 1 wherein said adjacent end of said second body section includes an outwardly projecting arm, and said adjacent end of said first body section includes axially extending openings dimensioned to receive in snap-locking manner said arm.

3. An abrasive tool as defined in claim 1 wherein said lateral side walls are smoothly contoured to said workpiece engaging portion.

4. An abrasive tool as defined in claim 1 wherein said biasing means is a coiled spring.

5. An abrasive tool as defined in claim 1 wherein said wedge-shaped workpiece engaging portion is comprised of a first surface coplanar with the surface of said path along said handle portion and a second surface generally oblique to said body.

6. A slender, hand-held tool for abrading, polishing, or sanding a planar or contoured surface comprising an elongated relatively thin prismatic unitary body assembly constructed to carry a removable, flexible endless strip longitudinally about said body assembly along a predetermined path, said body assembly including:

a first relatively long main body section of molded plastic composition, said first body section including narrow surfaces on opposite sides thereof defining said path, and a surface engaging portion aligned with said narrow surfaces at one end thereof;

tension means disposed at the other end of said first section operative to releasably hold said strip in tension in contact with said path; and, locking means permanently connecting said tension means to said main body portion to form said unitary body assembly said locking means allowing limited longitudinal movement between said body section and said tension means;

said first body section including guides laterally disposed along said narrow surfaces to align said strip with respect to said surface engaging portion, said guides forming a handle portion for gripping said tool.

7. A tool as defined in claim 6 wherein said workpiece engaging portion is generally wedge-shaped.

8. A tool as defined in claim 6 wherein said tension means is comprised of:

a second shorter body section of molded plastic composition in longitudinal coplanar alignment with said first section, said second section including means slidably received in said first section in snap-lock fashion to effected limited longitudinal movement between said sections, and, means biasing said sections longitudinally apart.

9. A tool as defined in claim 8 wherein, said means slidably received in said first section is comprised of an arm extending outwardly from said second section aligned with an opening in said first section, and, said biasing means is a spring disposed about said stem, the ends of said spring engaging adjacent ends of said first and second body sections.

10. A tool as defined in claim 6 wherein said guides are smoothly contoured to said workpiece engaging portion.

11. A tool as defined in claim 6 wherein said workpiece engaging portion is generally wedge-shaped.

12. A slender, hand-held tool for abrading, polishing, or sanding a planar or contoured surface comprising an elongated relatively thin prismatic body assembly constructed to carry a thin, flexible endless abrasive strip longitudinally about said body assembly along a predetermined path, said body assembly including:

a first relatively long main body section of molded plastic composition, said first body section including narrow surfaces on opposite sides thereof defining said path, a surface engaging portion aligned with said narrow surfaces at one end thereof, and guides laterally disposed along said narrow surfaces to align said strip with respect to said surface engaging portion, the width of said narrow surfaces being less than one (1) inch;

tension means disposed at the other end of said first section operative to releasably hold said strip in tension in contact with said path; and means for maintaining said tension means in operative alignment with said body section.

13. A tool as defined in claim 12 wherein said maintaining means is an arm extending outwardly from said tension means adapted to be received in an opening in said other end of said first section.

14. A tool as defined in claim 13 wherein said extending arm is received in said opening in snap-lock fashion.

15. A slender, hand-held tool for abrading, polishing, or sanding a planar or contoured surface comprising an elongated relatively thin prismatic body assembly constructed to carry a removable, flexible endless abrasive strip longitudinally about said body assembly along a predetermined path, said body assembly including:

a first relatively long main body section of molded plastic composition, said first body section including narrow surfaces on opposite sides thereof defining said path and a surface engaging portion aligned with said narrow surfaces at one end thereof;

guide means disposed along said narrow surfaces for aligning said strip with respect to said surface engaging portion; and tension means disposed at the other end of said first section operative to releasably hold said strip in tension in contact with said path; said tool being less than nine (9) inches in length and carrying an abrasive strip less than one-half (0.5) inch in width.

16. A tool as defined in claim 15 further comprising means for joining said tension means to said body section.

17. A tool as defined in claim 16 wherein said means for joining comprises an arm extending outwardly from said tension means adapted to be received in snap-lock fashion in an opening in said other end of said first section.

18. A slender, hand-held tool for abrading, polishing, or sanding a planar or contoured surface comprising an elongated relatively thin prismatic body assembly constructed to carry a removable, flexible endless abrasive strip longitudinally about said body assembly along a predetermined path, said body assembly including:

a first relatively long main body section of molded plastic composition, said first body section including narrow surfaces on opposite sides thereof defining said path and a surface engaging portion aligned with said narrow surfaces at one end thereof;

guide means disposed along said narrow surfaces for aligning said strip with respect to said surface engaging portion;

tension means disposed at the other end of said first section operative to releasably hold said strip in tension in contact with said path; and means for maintaining said tension means in operative alignment with said body section, said tool having an overall length at least 10 times greater than the width of said narrow surfaces.

19. A tool as defined in claim 18 wherein said maintaining means is an arm extending outwardly from said tension means adapted to be received in an opening in said other end of said fist section.

20. A tool as defined in claim 19 wherein said extending arm is received in said opening in snap-lock fashion.

* * * * *